US006213470B1

(12) United States Patent
Miller

(10) Patent No.: US 6,213,470 B1
(45) Date of Patent: Apr. 10, 2001

(54) PRECISE AIM SIGHTING TARGET

(76) Inventor: Terry K. Miller, RD #1 Box 10 K, Benezette, PA (US) 15821-9407

( * ) Notice: Subject to any disclaimer, the term of this patent is extended or adjusted under 35 U.S.C. 154(b) by 0 days.

(21) Appl. No.: 09/456,379

(22) Filed: Dec. 8, 1999

Related U.S. Application Data

(60) Provisional application No. 60/129,633, filed on Apr. 16, 1999.

(51) Int. Cl.[7] ..... F41J 1/04
(52) U.S. Cl. ..... 273/409
(58) Field of Search ..... 273/408, 409, 273/403, 404, 348; D22/113; 434/19; 33/293, 294

(56) References Cited

U.S. PATENT DOCUMENTS

D. 259,357 5/1981 Dulude .
D. 269,631 7/1983 Dulude .
1,203,472 * 10/1916 Branch ..... 273/409
3,439,970 4/1969 Rickert .
4,244,586 * 1/1981 Gorrow ..... 273/409
4,790,075 12/1988 Howard, Sr. .
4,976,038 12/1990 Nattrass .
5,415,415 * 5/1995 Mujic ..... 273/409
5,456,035 10/1995 Stiles .
5,519,941 5/1996 Yusko .
5,642,886 * 7/1997 Yancey, Jr. ..... 273/409
5,860,655 * 1/1999 Starrett ..... 273/409

* cited by examiner

*Primary Examiner*—Mark S. Graham
(74) *Attorney, Agent, or Firm*—Richard C. Litman

(57) ABSTRACT

A sighting target for positioning at various fixed distances for calibration of a telescopic sight on a firearm such as a pistol, rifle and the like. The target has an X positioned against a white background having square grids with black lines. The stripes are colored orange with black edges. At the intersection a circle is delineated in black. The ends of the X do not terminate at the corners of the target, but terminate proximate to the vertical edges. The X of the cross hairs of the telescopic sight is aligned with the X of the target in an efficient and effective manner for a specific distance.

4 Claims, 2 Drawing Sheets

PRECISE AIM SIGHTING TARGET

CROSS-REFERENCE TO RELATED APPLICATION

This application claims the benefit of U.S. Provisional Patent Application Serial No. 60/129,633, filed Apr. 16, 1999.

BACKGROUND OF THE INVENTION

1. Field of the Invention

The present invention relates to an improved sighting-in target for a pistol or a rifle.

2. Description of Related Art

The related art of interest describes various sighting-in targets external to and within telescopes, but none disclose the present invention. There is a need for a simplified but distinctive sighting-in target usable for sighting in any firearm quickly and efficiently. The related art will be described in the order of perceived relevance to the present invention.

U.S. Design Pat. No. 269,631 issued on Jul. 5, 1983, to Charles R. Dulude describes a gun target having up to four octagons having concave edges with every other segment blackened. The targets having a plurality of octagons arrange the octagons in various positions. This target is distinguishable for its triangular black segments pointing to a center without a discrete circle as in the present invention. Moreover, it is clear that the targets are intended as shooting targets due to the plurality of octagons on a target and not as sighting in targets for a telescopic sight on a gun or rifle.

U.S. Design Patent No. 259,357 issued on May 26, 1981, to Charles R. Dulude describes a gun target with two or four circular targets, wherein each target has one or two circles intersected by four blackened triangular segments with their apices meeting at the center. The binary target has squares in each outer blank circle. Again, these targets are distinguishable as shooting targets and are not sighting in targets. The center of each target lacks the small circle of the present invention.

U.S. Pat. No. 4,790,075 issued on Dec. 13, 1988, to Alfred R. Howard, Sr. describes a second embodiment of a portable removable gun sight (non-telescopic) mounted close to the front end of a rifle barrel employing two criss-crossed bands countersunk in the slots of a circular structure. The gun sight with its sight pattern is distinguishable for being located on the rifle barrel.

U.S. Pat. No. 4,976,038 issued on Dec. 11, 1990, to Floyd C. Nattrass describes a shotgun sighting system and method. The system employs the forward end shotgun sight and a rearward transient sighting element. The target shown is a conventional bull's-eye target with rings.

U.S. Pat. No. 3,439,970 issued on Apr. 22, 1969, to Glenn E. Rickert describes an optical sighting device positioned at the rear of a rifle employing a fluorescent lighted reticle face. The target is a conventional bull's-eye target.

U.S. Pat. No. 5,456,035 issued on Oct. 10, 1995, to Hallett R. Stiles describes a reticle gunsight illuminated by a chemical illumination stick which is inserted through a tapped port in a lower chamber of the gunsight. The target is another conventional bull's eye target.

U.S. Pat. No. 5,519,941 issued on May 28, 1996, to Michael C. Yusko describes a sight system useful for a handgun with front and rear sights. The front circular sight has a vertical slot for alignment with the circular opening of the rear sight. The handgun sight system is distinguishable for its limitation to the sights of a handgun.

None of the above inventions and patents, taken either singly or in combination, is seen to describe the instant invention as claimed.

SUMMARY OF THE INVENTION

The present invention is directed to a sighting target to be positioned at various fixed distances for calibration of a telescopic sight on a firearm such as a pistol, rifle and the like. The target has an X positioned against a white background, which has square grids with black lines. The X-stripes are colored orange with black edges. At the intersection a circle is delineated in black. The ends of the X do not terminate at the corners of the target, but terminate proximate to the vertical edges. The X of the cross hairs of the telescopic sight is aligned with the X of the target in an efficient and effective manner for a specific distance.

Accordingly, it is a principal object of the invention to provide a sighting target for calibration of a telescopic sight on a firearm.

It is another object of the invention to provide a sighting target for any firearm having a telescopic sight with cross-hairs.

It is a further object of the invention to provide a sighting target having an X-mark for coinciding with the cross-hairs of a telescopic sight on a firearm.

Still another object of the invention is to provide a sighting target having a center circle at the intersection of the X-mark.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to a target designed to improve the efficiency of sighting in a telescopic sight with inclined cross hairs, i.e., X-shaped, on any firearm which includes pistols, semiautomatic firearms and automatic firearms.

Figure 1:
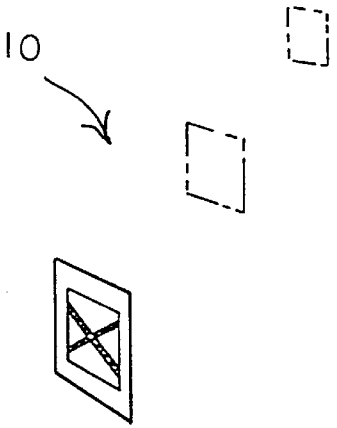
FIG. 1 is an environmental, perspective view of a rifleman sighting in his telescopic sight on a precise aim sighting target at a fixed distance according to the present invention.
Figure 1:
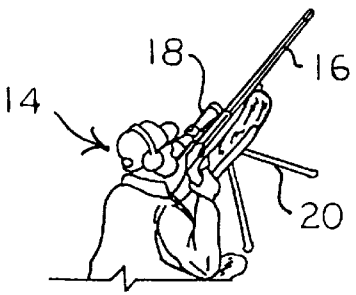
Figure 2:
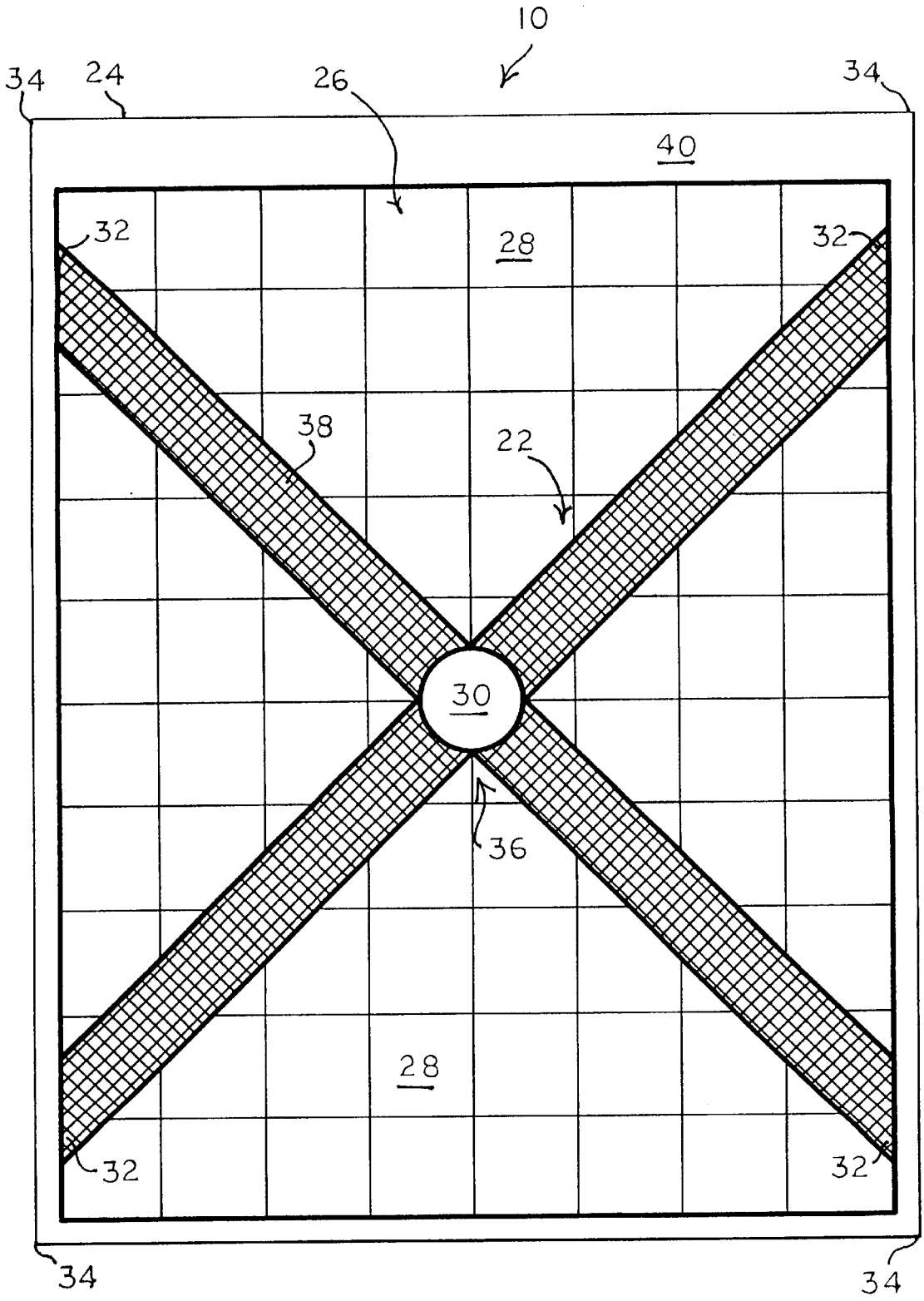
FIG. 2 is a front elevational view of the precise aim target with orange stripes on a grid background with a circle positioned at the intersection of the orange stripes.

In FIG. 1, a series of three targets 10 of the present invention are positioned in a field or rifle range 12 at various exemplary distances such as 50 yards, 100 yards and 150 yards. A rifleman 14 is sighting in his rifle 16 with a telescopic sight 18 on a stable support such as a tripod 20. His telescopic sight 18 has cross hairs (not shown) which are similar in shape with the X-shaped mark 22 on the target 10 depicted in FIG. 2.

A rectangular white sheet 24 has a grid 26 of squares 28 delineated in black lines. A circle 30 is delineated in a black line and centered on the rectangular white sheet 24. The X-shaped mark 22 is positioned on the rectangular sheet 24 with its ends 32 proximate the corners 34 and its intersection 36 coincident with the circle 30.

The X-shaped mark 22 has a preferred orange coloration 38 (outlined by thin black lines) which is deemed to provide the best coloration for viewing marks at a distance. A red color would look dark to color-blind people and possibly overshadow the white circle. A yellow or pink color would appear faint at a distance as viewed through a telescopic sight 18.

The white border 40 on the target 10 can be dispensed with since the critical markings are the circle 30 at the intersection 36 of the X-shaped mark 22.

Exemplary dimensions of the target 10 can be as follows:

8.5 in.×11 in.; 1 in. diameter circle; 0.75 in. width of X segments.

12.5 in.×14.5 in.; 2 in. diameter circle; 1.5 in. width of X segments.

It should be noted that the target 10 can be made smaller or larger than recited if there is a demand. In such a case, the changes in overall size would add or subtract approximately 4 in. to the length and width of the above listed sizes.

It has been found that sighting in of a firearm equipped with a telescopic sight is made effectively and in a minimum of time for various distances. Consequently, a hunter develops an increased confidence in the accuracy of one's firearm before going afield.

It is to be understood that the present invention is not limited to the sole embodiment described above, but encompasses any and all embodiments within the scope of the following claims.

I claim:

1. A precise aim pointing target for sighting in any firearm with a telescopic sight having X shaped cross hairs, comprising:

a rectangular white sheet having a grid of squares delineated in black lines;

a circle delineated in a black line and centered on the rectangular sheet; and an X-shaped mark positioned on the rectangular sheet with its ends proximate the corners of the sheet and its intersection coincident with the circle.

2. The precise aim pointing target according to claim 1, including an orange coloration of the X-shaped mark.

3. The precise aim pointing target according to claim 2, wherein the orange coloration of the X-shaped mark is bordered with black lines.

4. The precise aim pointing target according to claim 2, wherein the ends of the X-shaped mark intersect vertical edges of the target.

* * * * *